United States Patent [19]

Coles

[11] Patent Number: 4,903,572

[45] Date of Patent: Feb. 27, 1990

[54] APPARATUS FOR MUSICAL SCALE SELECTION AND KEY SIGNATURE ACTUATION

[76] Inventor: Donald K. Coles, 2505 Capitol Ave., Fort Wayne, Ind. 46806

[21] Appl. No.: 255,751

[22] Filed: Oct. 11, 1988

Related U.S. Application Data

[63] Continuation-in-part of Ser. No. 15,718, Feb. 17, 1987, abandoned, which is a continuation-in-part of Ser. No. 921,407, Oct. 22, 1986, Pat. No. 4,750,399, which is a continuation-in-part of Ser. No. 736,701, May 22, 1985, Pat. No. 4,640,173.

[51] Int. Cl.[4] ..... G10G 7/00

[52] U.S. Cl. ..... 84/442; 84/453

[58] Field of Search ..... 84/1.01, 1.03, 1.28, 84/428, 423 R, 423 A, 442, 445, 451, 453, 473, 474, 478, DIG. 23

[56] References Cited

U.S. PATENT DOCUMENTS

| | | | |
|---|---|---|---|
| 2,484,930 | 10/1949 | Cornelius | 84/1.01 |
| 3,890,871 | 6/1975 | Oberheim | 84/445 X |
| 3,986,422 | 10/1976 | Coles | 84/1.01 |
| 4,048,893 | 9/1977 | Coles | 84/1.01 |
| 4,198,890 | 4/1980 | Massey et al. | 84/1.01 |
| 4,640,173 | 2/1987 | Coles | 84/1.01 |
| 4,686,880 | 8/1987 | Salani et al. | 84/1.01 |
| 4,750,399 | 6/1988 | Coles | 84/478 |
| 4,777,857 | 10/1988 | Stewart | 84/1.01 |
| 4,821,619 | 4/1989 | Coles | 84/453 X |

FOREIGN PATENT DOCUMENTS 1470249 4/1977 United Kingdom .

OTHER PUBLICATIONS

Droman, David, *Exploring MIDI,* ComProducts, Huntington Beach, 1984, pp. 1–35.

MIDI 1.0 Detailed Specification, International MIDI Association, North Hollywood, 1985, pp. 1–30.

*Primary Examiner*—Stanley J. Witkowski

[57] ABSTRACT

When a musician presses the digital of a musical instrument, a digital identifying number is transmitted to a separate sound generator, where a tone of the appropriate pitch is generated. A musical scale selecting and musical key signature actuating apparatus intercepts this transmission. The apparatus contains a number changer which can change the numbers transmitted to the sound generator so that the same sequence of instrument digitals can sound either the diatonic scale or a musical scale having only six tones per octave, and a musician can play from music written in different diatonic musical keys with the sharps or flats in its key signature automatically actuated.

15 Claims, 8 Drawing Sheets

FIG. 1
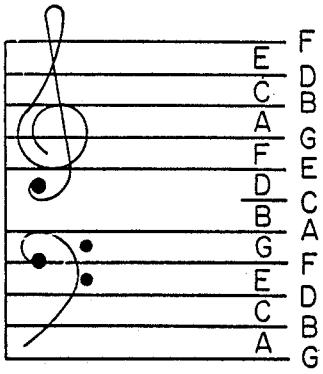
FIG. 2
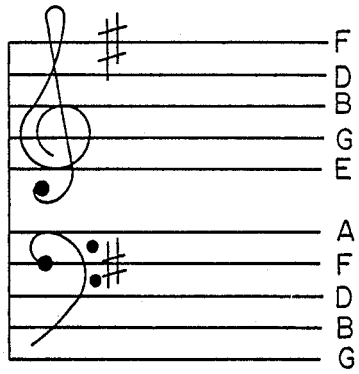
FIG. 3
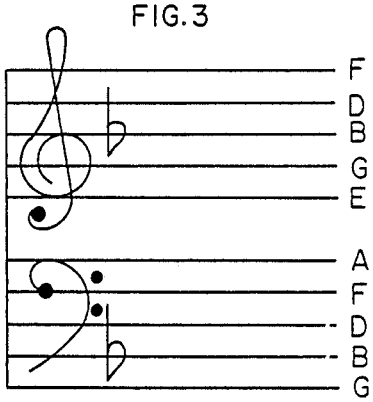
FIG. 4
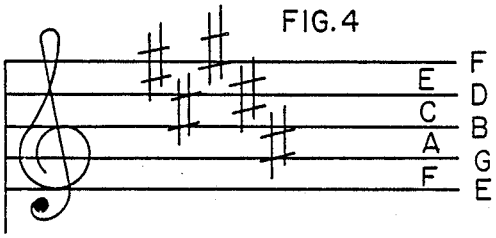
FIG. 5
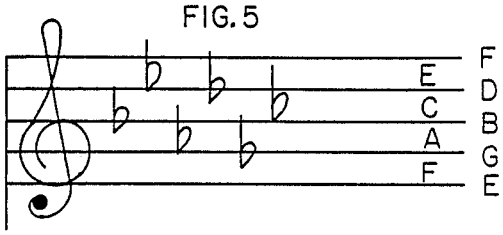
FIG. 6
| | F= KEY SIG. FLATS | | | | | | | | S= KEY SIG. SHARPS | | | | | | | |
|---|---|---|---|---|---|---|---|---|---|---|---|---|---|---|---|---|
| | 7 | 6 | 5 | 4 | 3 | 2 | 1 | 0 | 1 | 2 | 3 | 4 | 5 | 6 | 7 | |
| B | B♭ | B♭ | B♭ | B♭ | B♭ | B♭ | B♭ | | | | | | | | B♯ | 14 |
| | | | | | | | | | | | | | | | | 13 |
| A | A♭ | A♭ | A♭ | A♭ | A♭ | | | | | | | | A♯ | A♯ | A♯ | 12 |
| | | | | | | | | | | | | | | | | 11 |
| G | G♭ | G♭ | G♭ | | | | | | | | G♯ | G♯ | G♯ | G♯ | G♯ | 10 |
| | | | | | | | | | | | | | | | | 9 |
| F | F♭ | | | | | | | | F♯ | F♯ | F♯ | F♯ | F♯ | F♯ | F♯ | 8 |
| | | | | | | | | | | | | | | | | 7 |
| E | E♭ | E♭ | E♭ | E♭ | E♭ | E♭ | | | | | | | | E♯ | E♯ | 6 |
| | | | | | | | | | | | | | | | | 5 |
| D | D♭ | D♭ | D♭ | D♭ | | | | | | | | D♯ | D♯ | D♯ | D♯ | 4 |
| | | | | | | | | | | | | | | | | 3 |
| C | C♭ | C♭ | | | | | | | | C♯ | C♯ | C♯ | C♯ | C♯ | C♯ | 2 |
| | | | | | | | | | | | | | | | | 1 |
| | C♭ | G♭ | D♭ | A♭ | E♭ | B♭ | F | C | G | D | A | E | B | F♯ | C♯ | |

| | F = KEY SIG. FLATS | | | | | | | | S = KEY SIG. SHARPS | | | | | | | |
|---|---|---|---|---|---|---|---|---|---|---|---|---|---|---|---|---|
| | 7 | 6 | 5 | 4 | 3 | 2 | 1 | 0 | 1 | 2 | 3 | 4 | 5 | 6 | 7 | |
| B | -1 | -1 | -1 | -1 | -1 | -1 | -1 | 0 | 0 | 0 | 0 | 0 | 0 | 0 | +1 | 14 |
| | -1 | -1 | -1 | -1 | -1 | -1 | 0 | 0 | 0 | 0 | 0 | 0 | 0 | +1 | +1 | 13 |
| A | -1 | -1 | -1 | -1 | -1 | 0 | 0 | 0 | 0 | 0 | 0 | 0 | +1 | +1 | +1 | 12 |
| | -1 | -1 | -1 | -1 | 0 | 0 | 0 | 0 | 0 | 0 | 0 | +1 | +1 | +1 | +1 | 11 |
| G | -1 | -1 | -1 | 0 | 0 | 0 | 0 | 0 | 0 | 0 | +1 | +1 | +1 | +1 | +1 | 10 |
| | -1 | -1 | 0 | 0 | 0 | 0 | 0 | 0 | 0 | +1 | +1 | +1 | +1 | +1 | +1 | 9 |
| F | -1 | 0 | 0 | 0 | 0 | 0 | 0 | 0 | +1 | +1 | +1 | +1 | +1 | +1 | +1 | 8 |
| z | -1 | -1 | -1 | -1 | -1 | -1 | -1 | 0 | 0 | 0 | 0 | 0 | 0 | 0 | +1 | 7 |
| E | -1 | -1 | -1 | -1 | -1 | -1 | 0 | 0 | 0 | 0 | 0 | 0 | 0 | +1 | +1 | 6 |
| | -1 | -1 | -1 | -1 | -1 | 0 | 0 | 0 | 0 | 0 | 0 | 0 | +1 | +1 | +1 | 5 |
| D | -1 | -1 | -1 | -1 | 0 | 0 | 0 | 0 | 0 | 0 | 0 | +1 | +1 | +1 | +1 | 4 |
| | -1 | -1 | -1 | 0 | 0 | 0 | 0 | 0 | 0 | 0 | +1 | +1 | +1 | +1 | +1 | 3 |
| C | -1 | -1 | 0 | 0 | 0 | 0 | 0 | 0 | 0 | +1 | +1 | +1 | +1 | +1 | +1 | 2 |
| x | -1 | 0 | 0 | 0 | 0 | 0 | 0 | 0 | +1 | +1 | +1 | +1 | +1 | +1 | +1 | 1 |
| | C♭ | G♭ | D♭ | A♭ | E♭ | B♭ | F | C | G | D | A | E | B | F♯ | C♯ | |

FIG. 9

| | | F = KEY SIG. FLATS | | | | | | | | S = KEY SIG. SHARPS | | | | | | |
|---|---|---|---|---|---|---|---|---|---|---|---|---|---|---|---|---|
| | | 7 | 6 | 5 | 4 | 3 | 2 | 1 | 0 | 1 | 2 | 3 | 4 | 5 | 6 | 7 |
| B4 | 90 | -1 | -1 | -1 | -1 | -1 | -1 | -1 | 83 | 0 | 0 | 0 | 0 | 0 | 0 | +1 |
| | 89 | -1 | -1 | -1 | -1 | -1 | -1 | 0 | 82 | 0 | 0 | 0 | 0 | 0 | +1 | +1 |
| A4 | 88 | -1 | -1 | -1 | -1 | -1 | 0 | 0 | 81 | 0 | 0 | 0 | 0 | +1 | +1 | +1 |
| | 87 | -1 | -1 | -1 | -1 | 0 | 0 | 0 | 80 | 0 | 0 | 0 | +1 | +1 | +1 | +1 |
| G4 | 86 | -1 | -1 | -1 | 0 | 0 | 0 | 0 | 79 | 0 | 0 | +1 | +1 | +1 | +1 | +1 |
| | 85 | -1 | -1 | 0 | 0 | 0 | 0 | 0 | 78 | 0 | +1 | +1 | +1 | +1 | +1 | +1 |
| F4 | 84 | -1 | 0 | 0 | 0 | 0 | 0 | 0 | 77 | +1 | +1 | +1 | +1 | +1 | +1 | +1 |
| | 83 | -1 | -1 | -1 | -1 | -1 | -1 | -1 | 77 | 0 | 0 | 0 | 0 | 0 | 0 | +1 |
| E4 | 82 | -1 | -1 | -1 | -1 | -1 | -1 | 0 | 76 | 0 | 0 | 0 | 0 | 0 | +1 | +1 |
| | 81 | -1 | -1 | -1 | -1 | -1 | 0 | 0 | 75 | 0 | 0 | 0 | 0 | +1 | +1 | +1 |
| D4 | 80 | -1 | -1 | -1 | -1 | 0 | 0 | 0 | 74 | 0 | 0 | 0 | +1 | +1 | +1 | +1 |
| | 79 | -1 | -1 | -1 | 0 | 0 | 0 | 0 | 73 | 0 | 0 | +1 | +1 | +1 | +1 | +1 |
| C4 | 78 | -1 | -1 | 0 | 0 | 0 | 0 | 0 | 72 | 0 | +1 | +1 | +1 | +1 | +1 | +1 |
| | 77 | -1 | 0 | 0 | 0 | 0 | 0 | 0 | 71 | +1 | +1 | +1 | +1 | +1 | +1 | +1 |
| B3 | 76 | -1 | -1 | -1 | -1 | -1 | -1 | -1 | 71 | 0 | 0 | 0 | 0 | 0 | 0 | +1 |
| | 75 | -1 | -1 | -1 | -1 | -1 | -1 | 0 | 70 | 0 | 0 | 0 | 0 | 0 | +1 | +1 |
| A3 | 74 | -1 | -1 | -1 | -1 | -1 | 0 | 0 | 69 | 0 | 0 | 0 | 0 | +1 | +1 | +1 |
| | 73 | -1 | -1 | -1 | -1 | 0 | 0 | 0 | 68 | 0 | 0 | 0 | +1 | +1 | +1 | +1 |
| G3 | 72 | -1 | -1 | -1 | 0 | 0 | 0 | 0 | 67 | 0 | 0 | +1 | +1 | +1 | +1 | +1 |
| | 71 | -1 | -1 | 0 | 0 | 0 | 0 | 0 | 66 | 0 | +1 | +1 | +1 | +1 | +1 | +1 |
| F3 | 70 | -1 | 0 | 0 | 0 | 0 | 0 | 0 | 65 | +1 | +1 | +1 | +1 | +1 | +1 | +1 |
| | 69 | -1 | -1 | -1 | -1 | -1 | -1 | -1 | 65 | 0 | 0 | 0 | 0 | 0 | 0 | +1 |
| E3 | 68 | -1 | -1 | -1 | -1 | -1 | -1 | 0 | 64 | 0 | 0 | 0 | 0 | 0 | +1 | +1 |
| | 67 | -1 | -1 | -1 | -1 | -1 | 0 | 0 | 63 | 0 | 0 | 0 | 0 | +1 | +1 | +1 |
| D3 | 66 | -1 | -1 | -1 | -1 | 0 | 0 | 0 | 62 | 0 | 0 | 0 | +1 | +1 | +1 | +1 |
| | 65 | -1 | -1 | -1 | 0 | 0 | 0 | 0 | 61 | 0 | 0 | +1 | +1 | +1 | +1 | +1 |
| C3 | 64 | -1 | -1 | 0 | 0 | 0 | 0 | 0 | 60 | 0 | +1 | +1 | +1 | +1 | +1 | +1 |
| | 63 | -1 | 0 | 0 | 0 | 0 | 0 | 0 | 59 | +1 | +1 | +1 | +1 | +1 | +1 | +1 |
| B2 | 62 | -1 | -1 | -1 | -1 | -1 | -1 | -1 | 59 | 0 | 0 | 0 | 0 | 0 | 0 | +1 |
| | 61 | -1 | -1 | -1 | -1 | -1 | -1 | 0 | 58 | 0 | 0 | 0 | 0 | 0 | +1 | +1 |
| A2 | 60 | -1 | -1 | -1 | -1 | -1 | 0 | 0 | 57 | 0 | 0 | 0 | 0 | +1 | +1 | +1 |
| | 59 | -1 | -1 | -1 | -1 | 0 | 0 | 0 | 56 | 0 | 0 | 0 | +1 | +1 | +1 | +1 |
| G2 | 58 | -1 | -1 | -1 | 0 | 0 | 0 | 0 | 55 | 0 | 0 | +1 | +1 | +1 | +1 | +1 |
| | 57 | -1 | -1 | 0 | 0 | 0 | 0 | 0 | 54 | 0 | +1 | +1 | +1 | +1 | +1 | +1 |
| F2 | 56 | -1 | 0 | 0 | 0 | 0 | 0 | 0 | 53 | +1 | +1 | +1 | +1 | +1 | +1 | +1 |
| | 55 | -1 | -1 | -1 | -1 | -1 | -1 | -1 | 53 | 0 | 0 | 0 | 0 | 0 | 0 | +1 |
| E2 | 54 | -1 | -1 | -1 | -1 | -1 | -1 | 0 | 52 | 0 | 0 | 0 | 0 | 0 | +1 | +1 |
| | 53 | -1 | -1 | -1 | -1 | -1 | 0 | 0 | 51 | 0 | 0 | 0 | 0 | +1 | +1 | +1 |
| D2 | 52 | -1 | -1 | -1 | -1 | 0 | 0 | 0 | 50 | 0 | 0 | 0 | +1 | +1 | +1 | +1 |
| | 51 | -1 | -1 | -1 | 0 | 0 | 0 | 0 | 49 | 0 | 0 | +1 | +1 | +1 | +1 | +1 |
| C2 | 50 | -1 | -1 | 0 | 0 | 0 | 0 | 0 | 48 | 0 | +1 | +1 | +1 | +1 | +1 | +1 |
| | 49 | -1 | 0 | 0 | 0 | 0 | 0 | 0 | 47 | +1 | +1 | +1 | +1 | +1 | +1 | +1 |

FIG. 10

| | | F = KEY SIG. FLATS | | | | | | | | S = KEY SIG. SHARPS | | | | | | | |
|---|---|---|---|---|---|---|---|---|---|---|---|---|---|---|---|---|---|
| | | 7 | 6 | 5 | 4 | 3 | 2 | 1 | 0 | 1 | 2 | 3 | 4 | 5 | 6 | 7 | WT |
| B4 | 90 | 82 | 82 | 82 | 82 | 82 | 82 | 82 | 83 | 83 | 83 | 83 | 83 | 83 | 83 | 84 | 86 |
| | 89 | 81 | 81 | 81 | 81 | 81 | 81 | 82 | 82 | 82 | 82 | 82 | 82 | 82 | 83 | 83 | 85 |
| A4 | 88 | 80 | 80 | 80 | 80 | 80 | 81 | 81 | 81 | 81 | 81 | 81 | 81 | 82 | 82 | 82 | 84 |
| | 87 | 79 | 79 | 79 | 79 | 80 | 80 | 80 | 80 | 80 | 80 | 80 | 81 | 81 | 81 | 81 | 83 |
| G4 | 86 | 78 | 78 | 78 | 79 | 79 | 79 | 79 | 79 | 79 | 79 | 80 | 80 | 80 | 80 | 80 | 82 |
| | 85 | 77 | 77 | 78 | 78 | 78 | 78 | 78 | 78 | 78 | 79 | 79 | 79 | 79 | 79 | 79 | 81 |
| F4 | 84 | 76 | 77 | 77 | 77 | 77 | 77 | 77 | 77 | 78 | 78 | 78 | 78 | 78 | 78 | 78 | 80 |
| | 83 | 76 | 76 | 76 | 76 | 76 | 76 | 76 | 77 | 77 | 77 | 77 | 77 | 77 | 77 | 78 | 79 |
| E4 | 82 | 75 | 75 | 75 | 75 | 75 | 75 | 76 | 76 | 76 | 76 | 76 | 76 | 76 | 77 | 77 | 78 |
| | 81 | 74 | 74 | 74 | 74 | 74 | 75 | 75 | 75 | 75 | 75 | 75 | 75 | 76 | 76 | 76 | 77 |
| D4 | 80 | 73 | 73 | 73 | 73 | 74 | 74 | 74 | 74 | 74 | 74 | 74 | 75 | 75 | 75 | 75 | 76 |
| | 79 | 72 | 72 | 72 | 73 | 73 | 73 | 73 | 73 | 73 | 73 | 74 | 74 | 74 | 74 | 74 | 75 |
| C4 | 78 | 71 | 71 | 72 | 72 | 72 | 72 | 72 | 72 | 72 | 73 | 73 | 73 | 73 | 73 | 73 | 74 |
| | 77 | 70 | 71 | 71 | 71 | 71 | 71 | 71 | 71 | 72 | 72 | 72 | 72 | 72 | 72 | 72 | 73 |
| B3 | 76 | 70 | 70 | 70 | 70 | 70 | 70 | 70 | 71 | 71 | 71 | 71 | 71 | 71 | 71 | 72 | 72 |
| | 75 | 69 | 69 | 69 | 69 | 69 | 69 | 70 | 70 | 70 | 70 | 70 | 70 | 70 | 71 | 71 | 71 |
| A3 | 74 | 68 | 68 | 68 | 68 | 68 | 69 | 69 | 69 | 69 | 69 | 69 | 69 | 70 | 70 | 70 | 70 |
| | 73 | 67 | 67 | 67 | 67 | 68 | 68 | 68 | 68 | 68 | 68 | 68 | 69 | 69 | 69 | 69 | 69 |
| G3 | 72 | 66 | 66 | 66 | 67 | 67 | 67 | 67 | 67 | 67 | 67 | 68 | 68 | 68 | 68 | 68 | 68 |
| | 71 | 65 | 65 | 66 | 66 | 66 | 66 | 66 | 66 | 66 | 67 | 67 | 67 | 67 | 67 | 67 | 67 |
| F3 | 70 | 64 | 65 | 65 | 65 | 65 | 65 | 65 | 65 | 66 | 66 | 66 | 66 | 66 | 66 | 66 | 66 |
| | 69 | 64 | 64 | 64 | 64 | 64 | 64 | 64 | 65 | 65 | 65 | 65 | 65 | 65 | 65 | 66 | 65 |
| E3 | 68 | 63 | 63 | 63 | 63 | 63 | 63 | 64 | 64 | 64 | 64 | 64 | 64 | 64 | 65 | 65 | 64 |
| | 67 | 62 | 62 | 62 | 62 | 62 | 63 | 63 | 63 | 63 | 63 | 63 | 63 | 64 | 64 | 64 | 63 |
| D3 | 66 | 61 | 61 | 61 | 61 | 62 | 62 | 62 | 62 | 62 | 62 | 62 | 63 | 63 | 63 | 63 | 62 |
| | 65 | 60 | 60 | 60 | 61 | 61 | 61 | 61 | 61 | 61 | 61 | 62 | 62 | 62 | 62 | 62 | 61 |
| C3 | 64 | 59 | 59 | 60 | 60 | 60 | 60 | 60 | 60 | 60 | 61 | 61 | 61 | 61 | 61 | 61 | 60 |
| | 63 | 58 | 59 | 59 | 59 | 59 | 59 | 59 | 59 | 60 | 60 | 60 | 60 | 60 | 60 | 60 | 59 |
| B2 | 62 | 58 | 58 | 58 | 58 | 58 | 58 | 58 | 59 | 59 | 59 | 59 | 59 | 59 | 59 | 60 | 58 |
| | 61 | 57 | 57 | 57 | 57 | 57 | 57 | 58 | 58 | 58 | 58 | 58 | 58 | 58 | 59 | 59 | 57 |
| A2 | 60 | 56 | 56 | 56 | 56 | 56 | 57 | 57 | 57 | 57 | 57 | 57 | 57 | 58 | 58 | 58 | 56 |
| | 59 | 55 | 55 | 55 | 55 | 56 | 56 | 56 | 56 | 56 | 56 | 56 | 57 | 57 | 57 | 57 | 55 |
| G2 | 58 | 54 | 54 | 54 | 55 | 55 | 55 | 55 | 55 | 55 | 55 | 56 | 56 | 56 | 56 | 56 | 54 |
| | 57 | 53 | 53 | 54 | 54 | 54 | 54 | 54 | 54 | 54 | 55 | 55 | 55 | 55 | 55 | 55 | 53 |
| F2 | 56 | 52 | 53 | 53 | 53 | 53 | 53 | 53 | 53 | 54 | 54 | 54 | 54 | 54 | 54 | 54 | 52 |
| | 55 | 52 | 52 | 52 | 52 | 52 | 52 | 52 | 53 | 53 | 53 | 53 | 53 | 53 | 53 | 54 | 51 |
| E2 | 54 | 51 | 51 | 51 | 51 | 51 | 51 | 52 | 52 | 52 | 52 | 52 | 52 | 52 | 53 | 53 | 50 |
| | 53 | 50 | 50 | 50 | 50 | 50 | 51 | 51 | 51 | 51 | 51 | 51 | 51 | 52 | 52 | 52 | 49 |
| D2 | 52 | 49 | 49 | 49 | 49 | 50 | 50 | 50 | 50 | 50 | 50 | 50 | 51 | 51 | 51 | 51 | 48 |
| | 51 | 48 | 48 | 48 | 49 | 49 | 49 | 49 | 49 | 49 | 49 | 50 | 50 | 50 | 50 | 50 | 47 |
| C2 | 50 | 47 | 47 | 48 | 48 | 48 | 48 | 48 | 48 | 48 | 49 | 49 | 49 | 49 | 49 | 49 | 46 |
| | 49 | 46 | 47 | 47 | 47 | 47 | 47 | 47 | 47 | 48 | 48 | 48 | 48 | 48 | 48 | 48 | 45 |

FIG.11

| | | F = KEY SIG. FLATS | | | | | | | | S = KEY SIG. SHARPS | | | | | | | |
|---|---|---|---|---|---|---|---|---|---|---|---|---|---|---|---|---|---|
| | | 7 | 6 | 5 | 4 | 3 | 2 | 1 | 0 | 1 | 2 | 3 | 4 | 5 | 6 | 7 | WT |
| B4 | f5 | b4 | b4 | b4 | b4 | b4 | b4 | b4 | B4 | B4 | B4 | B4 | B4 | B4 | B4 | C5 | D5 |
| | F5 | A4 | A4 | A4 | A4 | A4 | A4 | b4 | b4 | b4 | b4 | b4 | b4 | b4 | B4 | B4 | c5 |
| A4 | E5 | a4 | a4 | a4 | a4 | a4 | A4 | A4 | A4 | A4 | A4 | A4 | A4 | b4 | b4 | b4 | C5 |
| | e5 | G4 | G4 | G4 | G4 | a4 | a4 | a4 | a4 | a4 | a4 | a4 | A4 | A4 | A4 | A4 | B4 |
| G4 | D5 | f4 | f4 | f4 | G4 | G4 | G4 | G4 | G4 | G4 | G4 | a4 | a4 | a4 | a4 | a4 | b4 |
| | c5 | F4 | F4 | f4 | f4 | f4 | f4 | f4 | f4 | f4 | G4 | G4 | G4 | G4 | G4 | G4 | A4 |
| F4 | C5 | E4 | F4 | F4 | F4 | F4 | F4 | F4 | F4 | f4 | f4 | f4 | f4 | f4 | f4 | f4 | a4 |
| | B4 | E4 | E4 | E4 | E4 | E4 | E4 | E4 | F4 | F4 | F4 | F4 | F4 | F4 | F4 | f4 | G4 |
| E4 | b4 | e4 | e4 | e4 | e4 | e4 | e4 | E4 | E4 | E4 | E4 | E4 | E4 | E4 | F4 | F4 | f4 |
| | A4 | D4 | D4 | D4 | D4 | D4 | e4 | e4 | e4 | e4 | e4 | e4 | e4 | E4 | E4 | E4 | F4 |
| D4 | a4 | c4 | c4 | c4 | c4 | D4 | D4 | D4 | D4 | D4 | D4 | D4 | e4 | e4 | e4 | e4 | E4 |
| | G4 | C4 | C4 | C4 | c4 | c4 | c4 | c4 | c4 | c4 | c4 | D4 | D4 | D4 | D4 | D4 | e4 |
| C4 | f4 | B3 | B3 | C4 | C4 | C4 | C4 | C4 | C4 | C4 | c4 | c4 | c4 | c4 | c4 | c4 | D4 |
| | F4 | b3 | B3 | B3 | B3 | B3 | B3 | B3 | B3 | C4 | C4 | C4 | C4 | C4 | C4 | C4 | c4 |
| B3 | E4 | b3 | b3 | b3 | b3 | b3 | b3 | b3 | B3 | B3 | B3 | B3 | B3 | B3 | B3 | C4 | C4 |
| | e4 | A3 | A3 | A3 | A3 | A3 | A3 | b3 | b3 | b3 | b3 | b3 | b3 | b3 | B3 | B3 | B3 |
| A3 | D4 | a3 | a3 | a3 | a3 | a3 | A3 | A3 | A3 | A3 | A3 | A3 | A3 | b3 | B3 | B3 | b3 |
| | c4 | G3 | G3 | G3 | G3 | a3 | a3 | a3 | a3 | a3 | a3 | a3 | A3 | A3 | A3 | A3 | A3 |
| G3 | C4 | f3 | f3 | f3 | G3 | G3 | G3 | G3 | G3 | G3 | G3 | a3 | a3 | a3 | a3 | a3 | a3 |
| | B3 | F3 | F3 | f3 | f3 | f3 | f3 | f3 | f3 | f3 | G3 | G3 | G3 | G3 | G3 | G3 | G3 |
| F3 | b3 | E3 | F3 | F3 | F3 | F3 | F3 | F3 | F3 | f3 | f3 | f3 | f3 | f3 | f3 | f3 | f3 |
| | A3 | E3 | E3 | E3 | E3 | E3 | E3 | E3 | F3 | F3 | F3 | F3 | F3 | F3 | F3 | f3 | F3 |
| E3 | a3 | e3 | e3 | e3 | e3 | e3 | e3 | E3 | E3 | E3 | E3 | E3 | E3 | E3 | F3 | F3 | E3 |
| | G3 | D3 | D3 | D3 | D3 | D3 | e3 | e3 | e3 | e3 | e3 | e3 | e3 | E3 | E3 | E3 | e3 |
| D3 | f3 | c3 | c3 | c3 | c3 | D3 | D3 | D3 | D3 | D3 | D3 | D3 | e3 | e3 | e3 | e3 | D3 |
| | F3 | C3 | C3 | C3 | c3 | c3 | c3 | c3 | c3 | c3 | c3 | D3 | D3 | D3 | D3 | D3 | c3 |
| C3 | E3 | B2 | B2 | C3 | C3 | C3 | C3 | C3 | C3 | C3 | c3 | c3 | c3 | c3 | c3 | c3 | C3 |
| | e3 | b2 | B2 | B2 | B2 | B2 | B2 | B2 | B2 | C3 | C3 | C3 | C3 | C3 | C3 | C3 | B2 |
| B2 | D3 | b2 | b2 | b2 | b2 | b2 | b2 | b2 | B2 | B2 | B2 | B2 | B2 | B2 | B2 | C3 | b2 |
| | c3 | A2 | A2 | A2 | A2 | A2 | A2 | b2 | b2 | b2 | b2 | b2 | b2 | b2 | B2 | B2 | A2 |
| A2 | C3 | a2 | a2 | a2 | a2 | a2 | A2 | A2 | A2 | A2 | A2 | A2 | A2 | b2 | b2 | b2 | a2 |
| | B2 | G2 | G2 | G2 | G2 | a2 | a2 | a2 | a2 | a2 | a2 | a2 | A2 | A2 | A2 | b2 | G2 |
| G2 | b2 | f2 | f2 | f2 | G2 | G2 | G2 | G2 | G2 | G2 | G2 | a2 | a2 | a2 | a2 | a2 | f2 |
| | A2 | F2 | F2 | f2 | f2 | f2 | f2 | f2 | f2 | f2 | G2 | G2 | G2 | G2 | G2 | G2 | F2 |
| F2 | a2 | E2 | F2 | F2 | F2 | F2 | F2 | F2 | F2 | f2 | f2 | f2 | f2 | f2 | f2 | f2 | E2 |
| | G2 | E2 | E2 | E2 | E2 | E2 | E2 | E2 | F2 | F2 | F2 | F2 | F2 | F2 | F2 | f2 | e2 |
| E2 | f2 | e2 | e2 | e2 | e2 | e2 | e2 | E2 | E2 | E2 | E2 | E2 | E2 | E2 | F2 | F2 | D2 |
| | F2 | D2 | D2 | D2 | D2 | D2 | e2 | e2 | e2 | e2 | e2 | e2 | e2 | E2 | E2 | E2 | c2 |
| D2 | E2 | c2 | c2 | c2 | c2 | D2 | D2 | D2 | D2 | D2 | D2 | D2 | e2 | e2 | e2 | e2 | C2 |
| | e2 | C2 | C2 | C2 | c2 | c2 | c2 | c2 | c2 | c2 | c2 | D2 | D2 | D2 | D2 | D2 | B1 |
| C2 | D2 | B1 | B1 | C2 | C2 | C2 | C2 | C2 | C2 | C2 | c2 | c2 | c2 | c2 | c2 | c2 | b1 |
| | c2 | b1 | B1 | B1 | B1 | B1 | B1 | B1 | B1 | C2 | C2 | C2 | C2 | C2 | C2 | C2 | A1 |

| | |
|---|---|
| NOTE | f |
| PLAY | 3 |

| | | | | | | | | | | | | | | | | |
|---|---|---|---|---|---|---|---|---|---|---|---|---|---|---|---|---|
| NOTE | f | c | c | c | c | D | D | D | D | D | D | D | e | e | e | e | D |
| PLAY | 3 | 3 | 3 | 3 | 3 | 3 | 3 | 3 | 3 | 3 | 3 | 3 | 3 | 3 | 3 | 3 | 3 |

| | |
|---|---|
| NOTE | E |
| PLAY | 2 |

| | | | | | | | | | | | | | | | | |
|---|---|---|---|---|---|---|---|---|---|---|---|---|---|---|---|---|
| NOTE | E | c | c | c | c | D | D | D | D | D | D | D | e | e | e | e | C |
| PLAY | 2 | 2 | 2 | 2 | 2 | 2 | 2 | 2 | 2 | 2 | 2 | 2 | 2 | 2 | 2 | 2 | 2 |

| | | | | | | | | | | | | | | | | |
|---|---|---|---|---|---|---|---|---|---|---|---|---|---|---|---|---|
| NOTE | a | c | c | c | c | D | D | D | D | D | D | D | e | e | e | e | E |
| PLAY | 4 | 4 | 4 | 4 | 4 | 4 | 4 | 4 | 4 | 4 | 4 | 4 | 4 | 4 | 4 | 4 | 4 |

FIG. 18

```
NOTE  CH
SPLT  1
```

FIG. 19

```
NOTE  CH cf
SPLT  1  25
```

FIG. 20

```
NOTE  !! 1 2 3 4 5 6 7 8 9 0 1 2 3 4 5 6
SPLT  1  * * * * * * * * * * * * * * *
      FLATS 7 6 5 4 3 2 1 0 1 2 3 4 5 6 7 SHARPS
```

FIG. 21

```
NOTE  !! 1 2 3 4 5 6 7 8 9 0 1 2 3 4 5 6
SPLT  1  *
      FLATS 7 6 5 4 3 2 1 0 1 2 3 4 5 6 7 SHARPS
```

FIG. 22

```
NOTE  CH
SPLT  2
```

FIG. 23

```
NOTE  !! 1 2 3 4 5 6 7 8 9 0 1 2 3 4 5 6
SPLT  2    *
      FLATS 7 6 5 4 3 2 1 0 1 2 3 4 5 6 7 SHARPS
```

FIG. 24

```
RUN     1 2 3 4 5 6 7 8 9 0 1 2 3 4 5 6
MIXER   * * * * * * * * * S * * * * * *
      FLATS 7 6 5 4 3 2 1 0 1 2 3 4 5 6 7 SHARPS
```

FIG. 25

| | S= KEY SIG. SHARPS | | | | | | | |
|---|---|---|---|---|---|---|---|---|
| R | 0 | 1 | 2 | 3 | 4 | 5 | 6 | 7 |
| 6 | 0 | 0 | 0 | 0 | 0 | 0 | 0 | +1 |
| 5 | 0 | 0 | 0 | 0 | 0 | 0 | +1 | +1 |
| 4 | 0 | 0 | 0 | 0 | 0 | +1 | +1 | +1 |
| 3 | 0 | 0 | 0 | 0 | +1 | +1 | +1 | +1 |
| 2 | 0 | 0 | 0 | +1 | +1 | +1 | +1 | +1 |
| 1 | 0 | 0 | +1 | +1 | +1 | +1 | +1 | +1 |
| 0 | 0 | +1 | +1 | +1 | +1 | +1 | +1 | +1 |

FIG. 26

| MODE | EXTRA TONES | BACK DIGITAL INTERDIG. INTERVALS | STARTING TONE |
|---|---|---|---|
| 1 | F, B | 2-2-1-2-2-2-1 | f |
| 2 | E, B | 2-2-1-2-2-2-1 | B |
| 3 | F, C | 2-2-1-2-2-2-1 | c |
| 4 | E, C | 2-1-2-2-2-2-1 | c |

FIG. 27

| | F = KEY SIG. FLATS | | | | | | | | S = KEY SIG. SHARPS | | | | | | |
|---|---|---|---|---|---|---|---|---|---|---|---|---|---|---|---|
| | 7 | 6 | 5 | 4 | 3 | 2 | 1 | 0 | 1 | 2 | 3 | 4 | 5 | 6 | 7 |
| B | -1 | -1 | -1 | -1 | -1 | -1 | -1 | 0 | 0 | 0 | 0 | 0 | 0 | 0 | +1 |
| | -1 | -1 | -1 | -1 | -1 | -1 | -1 | 0 | 0 | 0 | 0 | 0 | 0 | 0 | +1 |
| A | -1 | -1 | -1 | -1 | -1 | 0 | 0 | 0 | 0 | 0 | 0 | 0 | +1 | +1 | +1 |
| | -1 | -1 | -1 | -1 | -1 | 0 | 0 | 0 | 0 | 0 | 0 | 0 | +1 | +1 | +1 |
| G | -1 | -1 | -1 | 0 | 0 | 0 | 0 | 0 | 0 | 0 | +1 | +1 | +1 | +1 | +1 |
| | -1 | -1 | -1 | 0 | 0 | 0 | 0 | 0 | 0 | 0 | +1 | +1 | +1 | +1 | +1 |
| F | -1 | 0 | 0 | 0 | 0 | 0 | 0 | 0 | +1 | +1 | +1 | +1 | +1 | +1 | +1 |
| z | -1 | 0 | 0 | 0 | 0 | 0 | 0 | 0 | +1 | +1 | +1 | +1 | +1 | +1 | +1 |
| E | -1 | -1 | -1 | -1 | -1 | -1 | 0 | 0 | 0 | 0 | 0 | 0 | 0 | +1 | +1 |
| | -1 | -1 | -1 | -1 | -1 | -1 | 0 | 0 | 0 | 0 | 0 | 0 | 0 | +1 | +1 |
| D | -1 | -1 | -1 | -1 | 0 | 0 | 0 | 0 | 0 | 0 | 0 | +1 | +1 | +1 | +1 |
| | -1 | -1 | -1 | -1 | 0 | 0 | 0 | 0 | 0 | 0 | 0 | +1 | +1 | +1 | +1 |
| C | -1 | -1 | 0 | 0 | 0 | 0 | 0 | 0 | 0 | +1 | +1 | +1 | +1 | +1 | +1 |
| x | -1 | -1 | 0 | 0 | 0 | 0 | 0 | 0 | 0 | +1 | +1 | +1 | +1 | +1 | +1 |

FIG. 28

| | F = KEY SIG. FLATS | | | | | | | | S = KEY SIG. SHARPS | | | | | | |
|---|---|---|---|---|---|---|---|---|---|---|---|---|---|---|---|
| | 7 | 6 | 5 | 4 | 3 | 2 | 1 | 0 | 1 | 2 | 3 | 4 | 5 | 6 | 7 |
| B | -1 | -1 | -1 | -1 | -1 | -1 | -1 | 0 | 0 | 0 | 0 | 0 | 0 | 0 | +1 |
| | -1 | -1 | -1 | -1 | -1 | 0 | 0 | 0 | 0 | 0 | 0 | 0 | +1 | +1 | +1 |
| A | -1 | -1 | -1 | -1 | -1 | 0 | 0 | 0 | 0 | 0 | 0 | 0 | +1 | +1 | +1 |
| | -1 | -1 | -1 | 0 | 0 | 0 | 0 | 0 | 0 | 0 | +1 | +1 | +1 | +1 | +1 |
| G | -1 | -1 | -1 | 0 | 0 | 0 | 0 | 0 | 0 | 0 | +1 | +1 | +1 | +1 | +1 |
| | -1 | 0 | 0 | 0 | 0 | 0 | 0 | 0 | +1 | +1 | +1 | +1 | +1 | +1 | +1 |
| F | -1 | 0 | 0 | 0 | 0 | 0 | 0 | 0 | +1 | +1 | +1 | +1 | +1 | +1 | +1 |
| z | -1 | -1 | -1 | -1 | -1 | -1 | 0 | 0 | 0 | 0 | 0 | 0 | 0 | +1 | +1 |
| E | -1 | -1 | -1 | -1 | -1 | -1 | 0 | 0 | 0 | 0 | 0 | 0 | 0 | +1 | +1 |
| | -1 | -1 | -1 | -1 | 0 | 0 | 0 | 0 | 0 | 0 | 0 | +1 | +1 | +1 | +1 |
| D | -1 | -1 | -1 | -1 | 0 | 0 | 0 | 0 | 0 | 0 | 0 | +1 | +1 | +1 | +1 |
| | -1 | -1 | 0 | 0 | 0 | 0 | 0 | 0 | 0 | +1 | +1 | +1 | +1 | +1 | +1 |
| C | -1 | -1 | 0 | 0 | 0 | 0 | 0 | 0 | 0 | +1 | +1 | +1 | +1 | +1 | +1 |
| x | -1 | -1 | -1 | -1 | -1 | -1 | -1 | 0 | 0 | 0 | 0 | 0 | 0 | 0 | +1 |

APPARATUS FOR MUSICAL SCALE SELECTION AND KEY SIGNATURE ACTUATION

CROSS-REFERENCE TO RELATED APPLICATION

This application is a continuation-in-part of U.S. application Ser. No. 7/015,718 filed 2-17-87, abandoned, which is a continuation-in-part of U.S. application Ser. No. 921,407 filed 10-22-86, U.S. Pat. No. 4,750,399, which is a continuation-in-part of U.S. patent application Ser. No. 736,701 filed 5-22-85, U.S. Pat. No. 4,640,173.

BACKGROUND OF THE INVENTION

1. Field of the Invention

A musical scale selector for a musical keyboard allows different musical scales to be sounded on the same sequence of instrument digitals, thereby changing the keyboard fingering of musical compositions. This device eases the playing of music if the music is reprinted in an easier notation.

A key signature actuator for a musical keyboard eases playing from musical compositions written with difficult key signatures without reprinting the music, by changing the fingering of the musical compositions.

2. Description of the Prior Art

The traditional way of writing Western music is to represent the seven tones of a C major diatonic scale by notes on five-line staffs. Interspersed notes of the chromatic scale are referred to the notes of the basic diatonic scale by means of sharp or flat symbols which serve as corrections to the basic diatonic notes. Thus a chromatic note intermediate to the C and D note is represented by C sharp or D flat.

For a diatonic musical composition to be written without the use of sharp or flat symbols, it must be written in the key of C. Such a restriction would severely limit a modern composer, for he probably wants to base his musical composition on a tonic above or below a standard C pitch. This would be no problem for singers or for musical instruments having uniform pitch changers, but many musical instruments do not have such pitch changers. So composers and their publishers resort to a rather unsatisfactory method for changing the absolute pitch of their diatonic scale-they start the major mode of the diatonic scale on some other note than C. This method requires that one or more of the seven diatonic notes be corrected by means of a sharp or flat symbol. The composer finds it convenient to specify the diatonic note corrections by means of a key signature that is placed at the front of each line of written music. Key signatures greatly reduce the effort needed to write modern music in other keys than C, and to understand the written music.

The traditional musical keyboard was structured so as to facilitate performance of music in the major diatonic key of C. As early as the fifteenth century, keyboard instruments had seven front digitals to play the diatonic scale and five back digitals per octave span to play other notes of the chromatic scale. The major mode of a diatonic scale, starting with a C note, starts on a C front digital. The succeeding D,E,F,G,A,B notes of the diatonic scale are played on the succeeding D,E,F,G,A,B front digitals. The notes of written music can thus be interpreted as instructions to play particular digitals of the keyboard, each digital of the keyboard being identified by a note in the written music and serving to identify that musical note. This arrangement had the singular advantage that the most commonly used notes were played on the wide front digitals of the keyboard. At that time there was a one-to-one correspondence between the key in which music was written and played and the pitch of its diatonic scale as sounded.

Many modern keyboards are equipped with uniform pitch changers, which raise or lower the output tones from all the different digitals of the keyboard by the same musical interval. Since this type of transformation does not change the relative musical intervals between the different notes of a musical composition, it is recognized as the same musical composition sounded at a different overall pitch. Thus with many modern keyboards there is no longer a one-to-one correspondence between the key in which music is written and played and the pitch of its diatonic scale as sounded.

The note corrections specified by a key signature require playing of the back digitals. This detracts from the previous virtue of the traditional keyboard, of providing wide front digitals for the most commonly used notes. Furthermore, the ordinary keyboard player has difficulty remembering and playing all the sharps and flats called for in the fourteen key signatures. Music publishers have rewritten some of the older music with easier key signatures, but the rewritten music is usually harder to sing and it usually does not sound as good as when it was played in its original key. It is possible to reprint all music in the key of C for the benefit of musicians having uniform pitch changers, but the reprinted music would not be satisfactory for playing on instruments without uniform pitch changers, and publication of music written in different keys increases the logistic problem of distributing the written music.

To alleviate these difficulties, a keyboard instrument can be provided with a device to physically actuate the note corrections specified in the key signature. Such a device, which I call a key signature actuator, was disclosed by Martin Philipps in 1886 (U.S. Pat. Nos. 354,733, 466,907 and 519,071). If, for example, the device was set for a key signature with one sharp, then the F front digital would play not the F tone but the F sharp tone instead, as called out in the key signature.

As opposed to a uniform pitch changer, a key signature actuator changes some of the musical intervals between the tones sounded by a given sequence of digitals. For example, when the F front digital is made to sound the F sharp tone the interdigital musical interval between the E and F digitals is changed from one semitone to two semitones, and the interdigital musical interval between the F and G digitals is changed from two semitones to one semitone. A consequence of this difference between a key signature actuator and a uniform pitch changer is that key signature actuators are generally more difficult to construct, and they are not widely available.

Whereas the function of a uniform pitch changer is to change the overall pitch of the output music away from the pitch of the written music, the function of a key signature actuator is to ease playing from musical compositions written with difficult key signatures without rewriting the music, by changing the keyboard fingering of the musical compositions.

A key signature actuator greatly reduces the mechanical difficulty of playing in other keys than C, because the most frequently used notes are again played on the wide front digital of the keyboard. The mental difficulty of playing music is also reduced, because the musician can play the notes in the body of the written music without regard to its key signature. Unfortunately, partly because of their complexity and expense, key signature actuators are not generally available. If key signature actuators were available commercially, then a musical composition could more generally be published in the musical key in which it sounds best and is most easily sung. This better music could then be played by inexpert players on electronic musical instruments having key signature actuators. More expert musicians having acoustic instruments without either uniform pitch changers or key signature actuators could also play the better music.

Electrical versions of a key signature actuator are described in my U.S. Pat. Nos. 3,986,422, 4,048,893, 4,640,173, and 4,750,399, and my copending application Ser. No. 166,464, U.S. Pat. No. 4,821,619.

In modern musical practice it is common to have a musical keyboard and a sound generator in different places, the keyboard transmitting digital messages to the sound generator on a single pair of twisted wires. When a digital of the keyboard is pressed, a "Note On" message is transmitted in binary code to the sound module, accompanied by a digital identifying number. These messages are used by the sound module to generate a musical tone of the proper pitch. When the keyboard digital is released, a "Note Off" message, accompanied by the digital identifying number, is transmitted to the sound module, and the musical tone is discontinued. Musical instrument manufacturers have established an international standard for such communication, called "Musical Instrument Digital Interface" (MIDI).

My copending patent application Ser. Nos. 015,718 and 058,367 filed 6-5-87 disclose new uses for the MIDI interface whereby MIDI transmission to a sound generator is intercepted and the numbers changed in accordance with a selected key signature, the substituted numbers resulting in automatic actuation of the key signature. When the same musical composition is written in different keys, the key signature actuators allow all diatonic notes to be played on the front digitals of musical keyboards and the non-diatonic notes to be played on the back digitals of the keyboard. Application Ser. No. 058,367 filed Jun. 5, 1987 also causes interleaved whole tone scales to be played by the two rows of front and back digitals. This keyboard arrangement allows a musical composition to be played at all pitches with only two different relative fingerings, depending on whether the composition starts on a front or back digital. This is the best keyboard arrangement when playing from twelve-tone notation, which does not need key signatures.

SUMMARY OF THE INVENTION

In common musical practice, when a musician presses the digital of a musical keyboard, a message is transmitted to a separate sound generator, to tell it to generate a tone of the appropriate pitch. A traditional keyboard transmits "note on" and "note off" messages accompanied by a digital identifying number, using a standard method called "Musical Instrument Digital Interface" (MIDI), these messages being transmitted in binary code serially on a single pair of wires.

A musical scale selecting and musical key signature actuating apparatus intercepts this kind of transmission. The apparatus contains a number changer which can change the numbers transmitted to the sound generator so that a sequence of digital identifying numbers or note identifying numbers can sound either the whole tone scale or the diatonic scale, and can sound the diatonic scale in any selected one of fifteen different musical keys, with the sharps or flats in its key signature automatically actuated.

One object of the invention is to be able to select either diatonic scale or a six-tone musical scale to be sounded on the front digitals of a keyboard, and the other notes of the twelve-tone scale on the back digitals.

Another object of the invention is to reduce the mental difficulty of playing from music written with difficult key signatures; the player need not constantly remember the sharps or flats specified in a key signature, so can give more attention to expressive aspects of the music.

Another object of the invention is to reduce the mechanical difficulty of playing traditional keyboard music by enabling all diatonic notes of a musical composition written in any musical key to be played on the wide front digitals of the keyboard.

A still further object of the invention is to provide a diatonic key signature actuator with which the relative keyboard fingering of a musical composition is the same in all musical keys.

BRIEF DESCRIPTION OF THE DRAWINGS

FIGS. 1–5 show musical staffs, including key signatures.

FIG. 6 lists the fourteen traditional key signatures.

FIG. 7 is a block diagram of musical apparatus for selecting musical scales and actuating key signatures.

FIGS. 8 and 9 are tables of key signature corrections.

FIGS. 10 and 11 are look-up tables of pitch codes.

FIG. 12 is a block diagram of commercially available equipment that can be used for storing and retrieving pitch numbers.

FIGS. 13–23 show displays visible when storing pitch numbers.

FIG. 24 shows a display which is visible while actuating a key signature containing two sharps.

FIGS. 25, 27, 28 are key signature correction tables for other embodiments.

DESCRIPTION OF THE PREFERRED EMBODIMENT

Figure 8:
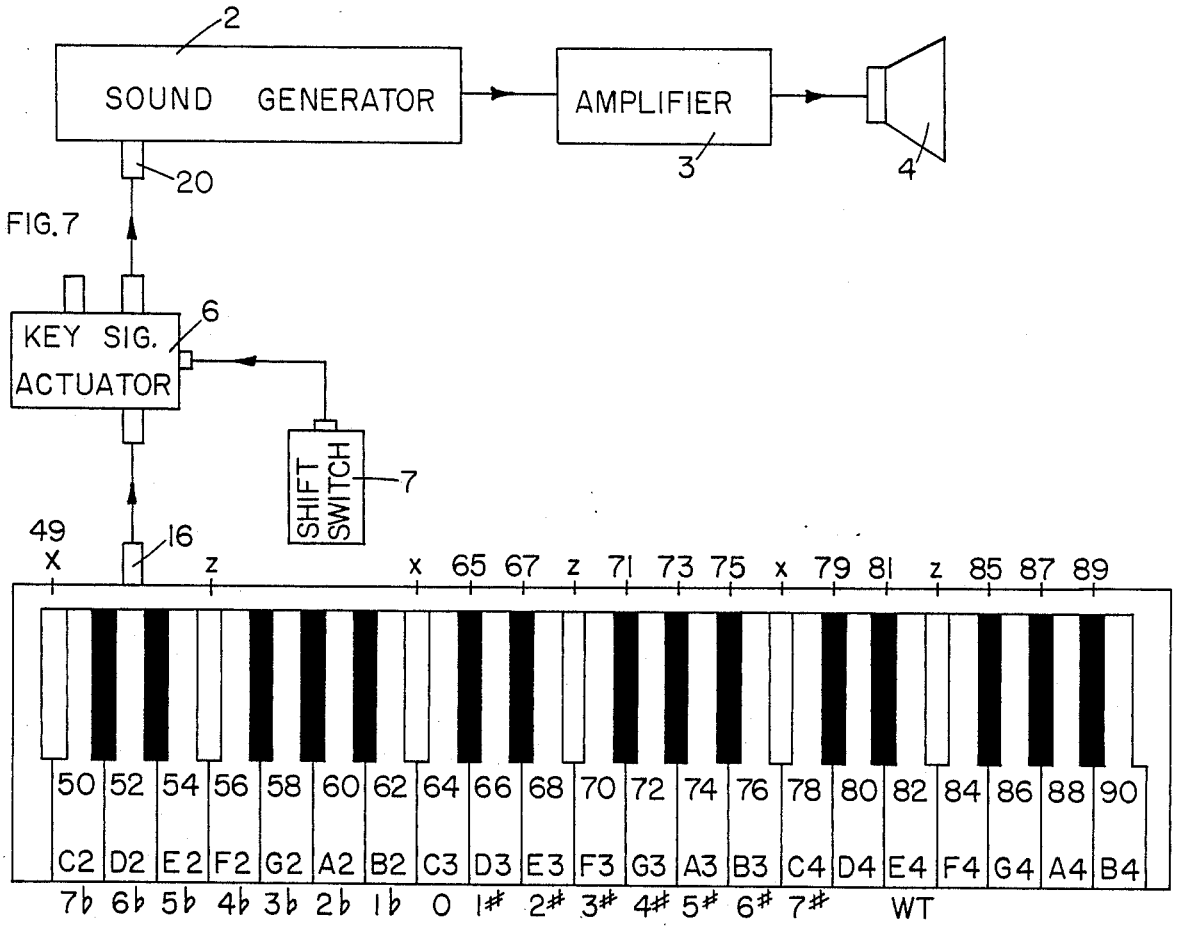

Traditional music notation is based on notes of the major diatonic scale, which has internote musical intervals of 2-2-1-2-2-2-1 semitones. Notation for keyboard music is shown in FIGS. 1–6. Referring to these figures, lines of the treble staff are labeled E,G,B,D,F. Spaces of this staff are labeled F,A,C,E. The musical staffs shown in FIG. 1 are used to play music in the key of C. Music to be played in one of the other fourteen keys uses a key signature as shown in FIGS. 2–6.

FIG. 2 shows a key signature indicating that the note F appearing in the body of the score should be corrected to F sharp. This correction allows the major diatonic scale to start on a G note instead of a C note. FIG. 3 shows a key signature indicating that the note B appearing in the body of the score should be corrected to B flat. This correction allows the major diatonic scale to start on the F note.

FIG. 4 shows a key signature having five sharps, which allows the major diatonic scale to start on the B note. FIG. 5 shows a key signature having six flats, which allows the major diatonic scale to start on the G flat note. The note corrections for the fourteen different key signatures are listed in FIG. 6.

Referring to FIG. 6, the top line shows F, the number of flats in a key signature, and S, the number of sharps in a key signature. The bottom line shows the keynotes corresponding to the different numbers of flats or sharps in a key signature. The first column shows the seven notes of the basic diatonic scale, starting with C and proceeding upward in pitch. The body of the table shows key signature substitutions for the different notes of the basic diatonic scale shown in the first column.

In common musical practice, each digital of a musical keyboard is assigned a digital identifying number, which number is commonly transmitted to a separate sound generator when the digital is pressed by a keyboard player. Reception of a "note on" message followed by the transmitted number tells the sound module to generate a musical tone of the appropriate pitch. The traditional keyboard commonly transmits "note on" and "note off" messages, accompanied by a digital identifying number, by a standard method called "Musical Instrument Digital Interface" (MIDI). Specifications for MIDI are published in the United States by the MIDI Manufactures Association and by the International MIDI Association in Los Angeles, CA. According to this interface standard, the numbers transmitted serially in binary code from the keyboard are 60 for middle C, 61 for C sharp, 62 for middle D, and so on. My new application of the MIDI interface uses a modified keyboard and a standard MIDI sound generator indicated in FIG. 7.

Referring to FIG. 7, keyboard 1 has seven front digitals per octave span and five back digitals which are shown black. These are the standard twelve musical note identified and identifying digitals found in most musical keyboards. In addition, keyboard 1 has two extra back digitals per diatonic octave span which are labeled x and z. The x back digital is provided to play the B natural note when the B front digital is playing the B flat note, and to play the C natural note when the C front digital is playing the C sharp note. The z back digital serves to play the F natural note when the F front digital is playing the F sharp note, as it does in all key signatures containing sharps, and to play the E natural note when the E front digital is playing the E flat note. The x and z extra back digitals are white so as to preserve the "landmark" function of the standard back digitals in orienting the player on the keyboard.

The row of numbers shown in FIG. 7 are digital identifying numbers which are transmitted in binary code serially from MIDI output terminal 16 on a single pair of twisted wires to key signature actuator 6. The digital identifying number which is transmitted when a keyboard digital is pressed must identify only that one keyboard digital. The musical scale selector and key signature actuator contains a number receiver, a number transmitter, and a number changer which has fifteen different states corresponding to the fifteen possible musical keys, and a sixteenth state for playing music from a notation that does not require key signatures. According to the selected state, the number changer answers each digital identifying number with a pitch number, which is transmitted in binary code serially on a second pair of twisted wires, along with its "note on" or "note off" message, to sound generator 2.

When musical scale selector and key signature actuator 6 is set for the key of C, it receives the digital identifying numbers D from keyboard 1 and transmits a standard set of pitch numbers to the sound module. Sound generator 2 is a commercial unit such as the Roland MKS-50, MKS-70 or MKS-80 Sound Generator. This sound module normally receives the pitch numbers and generates the musical tones they represent according to the MIDI specification. In the key of C the x extra digital is usually assigned the same pitch number as the standard B digital. The z extra digital is usually assigned the same pitch number as the standard F digital. But it is not essential that these two extra back digitals sound any tones when musical scale selector and playing in the standard key of C. When key signature actuator 6 is set to actuate a key signature, it corrects some of the standard pitch numbers before transmitting them to the sound module. The numerical corrections for the different key signatures are listed in FIG. 8.

Referring to FIG. 8, the top of the table shows F, the number of flats in a key signature, and S, the number of sharps in a key signature. The first column shows nine of the fourteen digitals in an octave span, starting with an x digital and progressing to the right on the keyboard. The central column corresponds to the standard key of C, which needs no flats or sharps in a key signature. The body of the table shows the numerical corrections to the pitch numbers for key signatures with different numbers of flats or sharps, relative to the pitch numbers for the standard key of C. Thus the negative numbers in the left half of the table correspond to a decrease of pitch of one semitone in the sound module. The positive numbers in the right half of the table correspond to an increase of pitch of one semitone in the sound module. Zeros in the table correspond to the same tones with a key signature that are produced in the key of C.

The right hand column of FIG. 8 shows the position of each digital in the octave span. For example, for a key signature with one sharp the first and eighth digitals have their pitch raised by a semitone. The second sharp in a key signature raises the pitches of the second and ninth digitals also, and so on. Half of the positive numbers in FIG. 8 are pitch increases for the front digitals, in exact correspondence with the sharps listed in FIG. 6. For example, the row of positive numbers for the eighth digital in FIG. 8 correspond to the row of F sharp substitutions for the F front digital shown in FIG. 6. The other half of the positive numbers in FIG. 8 are pitch increases for the back digitals, for them to take the place of front digitals in playing the natural tones. For example the first positive number for the first digital in FIG. 8 prepares the x back digital to play the C natural tone when the C front digital must play the C sharp tone.

Referring again to FIG. 7, when a musician presses a keyboard digital, the digital initiates transmission of its digital identifying number. Key signature actuator 6 intercepts this transmission and uses the digital identifying number as an address to find an answering pitch number. The pitch number which answers to the digital identifying number is then transmitted to the sound module.

Musical scale selector and key signature actuator 6 has a number receiver which receives binary coded numbers serially through a cable containing a first pair of wires, and a number transmitter to transmit binary coded pitch numbers serially through a cable containing a second pair of wires. Connected between the number receiver and the number transmitter is a number changer, which has fifteen different states corresponding to the fifteen different musical keys, and a sixteenth state in which the front digitals play a whole tone scale.

The number changer has stored pitch numbers for each value of S, the number of sharps in a key signature, and for each value of F, the number of flats in a key signature. The numbers S and F both range from zero to seven. S,F, and the digital identifying numbers serve as addresses in a look-up table of pitch numbers. Since the number changer has sixteen different states and forty-two digital identifying numbers for each state, the number of entries in its look-up table is at least $16 \times 42 = 672$.

Selection of a key signature could be made on a fifteen position switch in key signature actuator 6, but for economy and ease of selection I prefer to use fifteen front digitals of the keyboard. Footswitch 7 acts as a shift switch which shifts the "note on" MIDI messages and digital identifying numbers from these fifteen digitals so as to close electronic switches in key signature actuator 6 which serve to select a key signature. The electronic circuitry necessary to accomplish this is well known, the messages ordinarily received in commercial sound module 2 being used to close similar electronic switches that sound different musical tones. FIG. 7 indicates the fifteen front digitals that are used to select key signatures with different numbers of flats or sharps.

To select the key signature to be actuated, one momentarily steps on footswitch 7 and simultaneously presses one of the key selecting digitals. For example, to actuate a key signature having two flats one presses the second front digital to the left of the C3 digital in the keyboard. To actuate a key signature having three sharps, one presses the third front digital to the right of this C3 digital. After selecting a key signature of written music a musician plays the notes in the body of the written music, without regard to its key signature. Pressing the E4 front digital simultaneously with the footswitch selects a whole tone musical scale to be played on the front digitals of the keyboard, for playing music from a notation that does not need key signatures.

FIG. 8 has a general form which is applicable to all octaves of the keyboard. When the digital identifying numbers are introduced to address the stored corrections, and pitch numbers are introduced for the standard key of C, then the look-up table of corrections takes the form shown in FIG. 9.

FIG. 9 is similar to FIG. 8 except that the digital identifying numbers in the second column and pitch numbers for the key of C are shown for all three octaves of the keyboard. The digital identifying numbers are used as addresses for the table entries. The digital identifying numbers corresponding to the standard digitals are the standard digital identifying numbers, and their answering pitch numbers in the standard key of C are the standard pitch numbers.

The table entries as shown in FIG. 9 could be retrieved from storage and the corrections added to the pitch numbers for the key of C while the music is being played, but I preferably carry out the addition beforehand and store the corrected pitch numbers P.

The look-up table of pitch numbers obtained after performing the preliminary step of addition is shown in FIG. 10. As in FIG. 9, the top row in FIG. 10 shows F, the number of flats in a key signature and S, the number of sharps in the key signature. The second column shows the digital identifying numbers for the complete keyboard. The top row and second column serve as addresses for finding the individual pitch numbers. For example, for a key signature with four flats and a digital identifying number 80 the pitch number is equal to 73.

Thus if a musician sets the key signature actuator to a key signature having four flats, and then presses the D4 digital, the keyboard will transmit its associated identifying digital number 80 and the key signature actuator will transmit its associated pitch number 73 which makes the sound generator generate the tone of D flat. If the musician has need to sound the D natural tone, he must press the back digital to the immediate right of the D4 front digital. Inspection of FIG. 10 shows that pressing the digital with the digital identifying number 81 will indeed transmit the pitch number 74 to the sound generator, which causes it to generate the D natural tone. (The tone naturally played by the D front digital when playing in the key of C.)

Referring to FIG. 10, the sequence of eight even digital identifying numbers 64 to 78 inclusive are answered in the key of C by the pitch numbers 60,62,64,65,67,69,71,72. These eight pitch numbers are arranged in order of increasing integers. They differ from each other by the sequence of seven differences 2-2-1-2-2-2-1. With a key signature of one sharp (F sharp) this sequence of differences is 2-2-2-1-2-2-1. Addition of a second sharp (C sharp) changes this sequence of differences to 1-2-2-1-2-2-2.

Addition of four more sharps (G sharp, D sharp, A sharp and E sharp) changes this sequence of differences respectively to 1-2-2-2-1-2-2-,2-1-2-2-1-2-2,2-1-2-2-2-1-2 and 2-2-1-2-2-1-2. A uniform pitch changer cannot effect such changes of pitch number differences, for a uniform pitch changer raises or lowers all pitch numbers equally. These changes of consecutive pitch number differences are characteristic of key signature actuation. This musical scale selector and key signature actuator allows the same sequence of eight digitals to play seven different modes of the diatonic scale. Compared to the Major mode of the diatonic scale in the standard key of C, the number of raised tones per octave is equal to 2S, where S is the number of sharps in a key signature. Similarly, the number of lowered tones per octave is equal to 2F, where F is the number of flats in a key signature. For MIDI equipped instruments without digitals, such as a guitar, the numbers received by the key signature actuator can still identify notes in the body of written music, unmodified by any key signature.

The keyboard configuration shown in FIG. 7 is also the most suitable configuration for playing the whole tone scale on the front digitals of the keyboard. This a sixteenth state of the number changer is used to allow the sequence of eight even digital identifying numbers 64 to 78 to be answered by pitch numbers 60,62,64,66,68,70, 72,74, which are arranged in order of increasing integers. These eight pitch numbers differ from each other by the sequence of differences 2-2-2-2-2-2-2. This arrangement of musical intervals on the keyboard is the most suitable one for playing music written in twelve tone notation, as disclosed by Firestone in U.S. Pat. No. 2,406,946. That notation does not use flat or sharp symbols and avoids entirely the use of key signatures. The last column of FIG. 10 contains a set of pitch numbers P that are related to the digital identifying numbers D by the equation $P=D-4$. This column of the table is used to play a whole tone scale on the front digitals of the keyboard, and another whole tone scale on the back digitals.

The pitch numbers are transmitted in binary code serially on a single pair of twisted wires to sound module 2, shown in FIG. 7. The MIDI transmitter in key signature actuator 6 is like the standard transmitter in keyboard 1, transmitting from MIDI terminal 16. And the MIDI receiver musical scale selector and key signature actuator is like that in the commercial sound module 2, receiving on MIDI terminal 20. Details of the transmitter and receiver construction are given in the Detailed MIDI 1.0 Detailed Specification published by the International MIDI Association (1985), pages 1, 2. Details of transmitting, receiving and processing MIDI messages are well known to persons skilled in the art of MIDI equipped apparatus.

Equipment suitable for computing, storing and retrieving the pitch numbers is widely available in the computer industry. Equipment is also widely available in the music industry for storing pitch numbers, retrieving them, and transmitting them to a sound module via a MIDI cable. As an example, FIG. 12 shows commercial apparatus suitable for both storing tables of pitch numbers and using them for selecting musical scales and for actuating key signatures automatically.

Figures 12, 13, 14, 15, 16, 17:
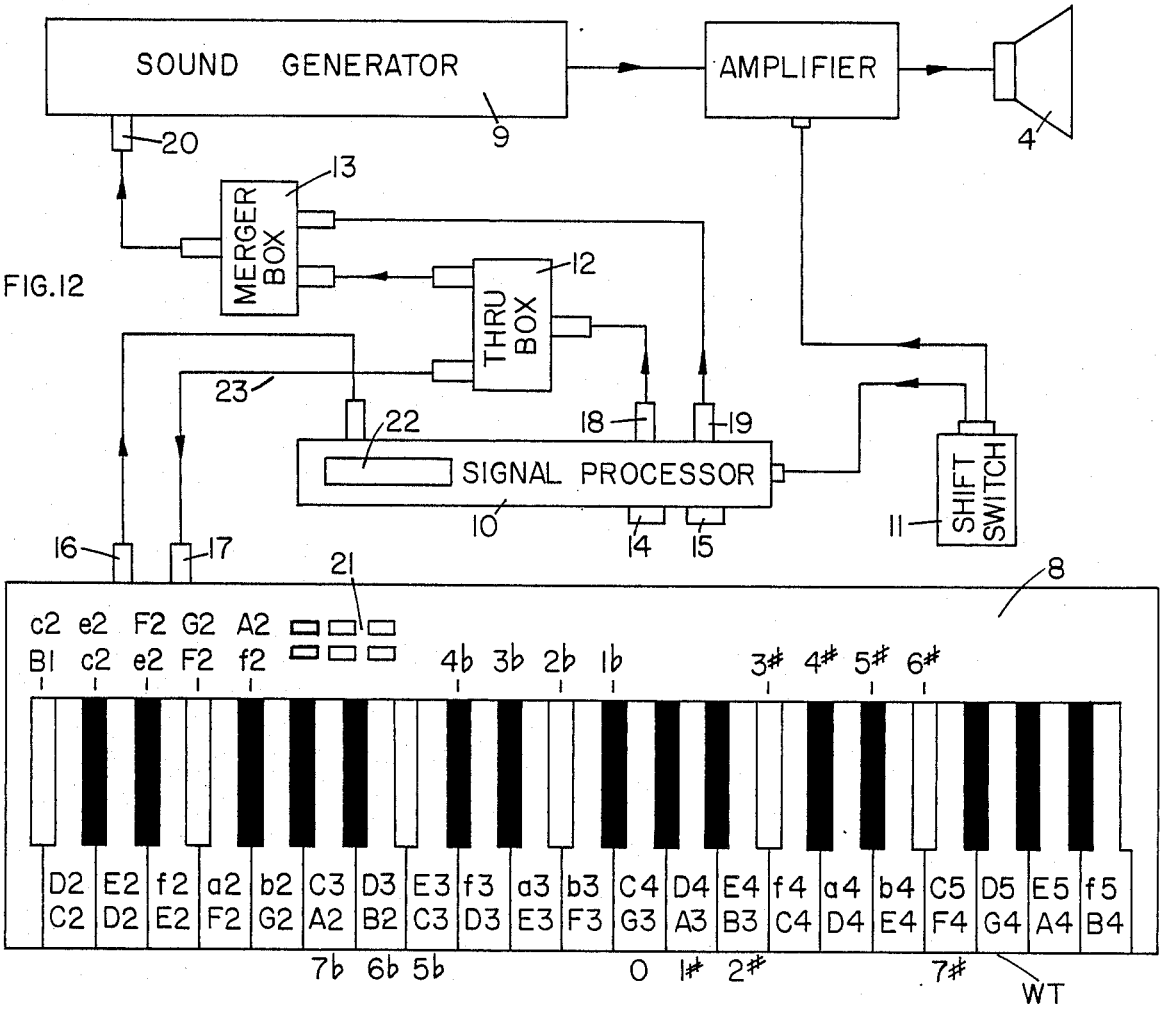

Referring to FIG. 12, keyboard 8 is similar to that in FIG. 7; when a digital is pressed the keyboard transmits its digital identifying number on MIDI output terminal 16. This keyboard has the customary group of pushbuttons 21 intended for voice control. Sound module 9 is a Roland MKS-50 Sound Module set to receive on all MIDI channels through MIDI input terminal 20. MIDI message processor 10 is marketed by Axxess Unlimited under the trademark MAPPER TM. The message processor has a MAIN pushbutton 14, a SUB pushbutton 15, and a display 22. Foot switch 11, when pressed, closes a circuit in the message processor, and it opens a circuit to loudspeaker 4. This latter feature is a modification of the commercial apparatus to prevent the loudspeaker from sounding a musical tone when a key signature is being selected. Thru box 12 is a Roland MM-4 unit, used to get MIDI feedback to the keyboard. MIDI merger 13 is marketed by J. L. Cooper Electronics under the trademark MIDI BLENDER TM. This is needed to merge the two outputs 18, 19 form the MIDI message processor for the present application.

Although the commercial apparatus of FIG. 12 receives, stores, and transmits MIDI messages as binary numbers, display 22 identifies these transactions by their MIDI equivalent letter codes. For direct comparison with this display, therefore, the digital identifying numbers shown in FIG. 7 are replaced on the keyboard of FIG. 12 by their equivalent letter codes. Codes for the chromatic notes C sharp, E flat, F sharp, A flat, B flat are the lower case letters c,e,f,a,b respectively. In FIG. 12 the digital identifying numbers 49 to 90 for the forty-two digitals are replaced by their MIDI equivalent codes c2 to f5.

In order to provide a convenient comparison with display 22, the digital identifying numbers and pitch numbers listed in the look-up table of FIG. 10 are also replaced by their MIDI-equivalent letter codes in the look-up table of FIG. 11. Referring to FIGS. 10 and 11, the forty-two digital identifying numbers 49 to 90 are replaced by their equivalent letter codes c2 to f5. The thirty-nine different pitch numbers 46 to 84 are replaced by their equivalent letter codes b1 to C5.

To store these pitch numbers using the musical keyboard and other apparatus of FIG. 12, main pushbutton 14 is used to select a Main Menu named "NOTE" and sub pushbutton 15 is used to select a Sub Menu named "PLAY". To store the address of pitch numbers for the keyboard middle D digital we must first depress foot pedal 11 and simultaneously press the D3 musical note identified digital, then release the foot pedal. The digital will transmit its digital identifying number to the message processor, which will display that digital code as in FIG. 13. To enter into memory the fifteen pitch numbers using the musical keyboard, which transmits only its digital identifying numbers, we must press digitals according to their digital codes, pressing four times the digital with the c3 digital code, seven times the digital with the D3 digital code, and four times the digital with the e3 digital code. Then for the whole tone scale we press the fourth digital to the left of the original D3 digital, to get the whole tone pitch number, which is four less than the digital identifying number it will be answering. Display 22 responds as shown in FIG. 14.

Referring to FIG. 14, the D digital plays D flat for a key signature with four or more flats, and D sharp for a key signature with four or more sharps. The entries in FIG. 14 agree with the entries for the D3 digital in FIGS. 9,10,11. The pitch code for the whole tone scale entry has been chosen to coincide with the standard pitch code for this middle D digital.

To store an address for pitch numbers for the low D digital, we depress foot pedal 11 and simultaneously press the D2 note identified digital, then release the pedal. The digital will transmit its digital code E2, which display 22 shows as in FIG. 15. Now to enter the fifteen pitch numbers from the musical keyboard, which transmits its digital identifying numbers, we must press the keyboard digitals according to their digital identifying codes, pressing four times the digital with the c2 digital code, seven times the digital with the D2 digital code, and four times the digital with the e2 digital code. Then for the whole tone scale entry press the fourth digital to the left of the original digital having the D2 note code. Display 22 responds as shown in FIG. 16. Comparing FIG. 16 with FIG. 14, we see that the key signature entries are an octave lower, but that the whole tone scale entry is fourteen semitones lower.

To store an address for pitch numbers for the high D digital, we depress foot pedal 11 and press the D4 note identified digital. This digital transmits its digital code a4, which serves as an address to retrieve the stored data. To enter the fifteen pitch numbers we press digitals according to their digital codes, pressing four times the digital with the c4 digital code, seven times the digital with the D4 digital code, and four times the digital with the e4 digital code. Then for the whole tone scale we press the fourth digital to the left of the original D4 digital. Display 22 responds as shown in FIG. 17. Comparing FIG. 17 with FIG. 14, we see that the key signature entries are an octave higher, but that the whole tone scale entry is fourteen semitones higher. Pitch numbers for the remaining thirty-nine keyboard digitals are stored in the same way, in accordance with FIGS. 11 and 12.

We must now provide means for selecting one of the key signatures and for retrieving the stored pitch numbers for that key signature. A convenient way to do this is to assign the fifteen musical keys to fifteen of the sixteen MIDI "channels" which are identified by four binary digits in the "note on" and "note off" messages. A MIDI message processor especially designed for use with a uniform keyboard will naturally select all sixteen MIDI channels on the front digitals of that keyboard, as shown in FIG. 7. But the commercial message processor 10 shown in FIG. 12 selects eight of the MIDI channels on back digitals of keyboard 8 shown in FIG. 12. Referring to FIG. 12, channels 1,2,3 are selected by front digitals with the C3, D3, E3 digital codes respectively. Channels 4,5,6,7 are selected by back digitals with the F3, G3, A3, B3 digital codes respectively. Channels 8,9,10 are selected by front digitals with the C4, D4, E4 digital codes. Channels 11,12,13,14 are selected by back digitals with the F4, G4, A4, B4 digital codes respectively. Channel 15, 16 are selected by front digitals with the C5, D5 digital codes. Channel 16 will be used to select the whole tone scale to be played on the front digitals of the keyboard.

To implement the association between key signature selections and MIDI channels, we use sub pushbutton 15 to get the SPLT sub menu. To get MIDI channel 1 we depress the pedal and simultaneously press the channel 1 selecting digital (C3). Display 22 responds as seen in FIG. 18. Because the MIDI message processor allows different parts of the keyboard to be split and treated differently, we must simultaneously press the extreme left and extreme right keyboard digitals to indicate that for our purpose the whole keyboard is to be treated in the same way. Display 22 responds as shown in FIG. 19. Now sub pushbutton 15 is pressed a second time simultaneously with depression of the foot pedal, giving a second level SPLT display as shown in FIG. 20. Referring to FIG. 20, asterisks numbered one to sixteen are associated respectively with the sixteen columns of pitch codes in FIG. 11. In order to assign the first column of pitch codes to the present channel one, we must leave the first asterisk in position one and remove the other asterisks. We do this by omitting the digital with the C3 digital code and pressing all the key selection digitals to its right on the keyboard. This toggles off fifteen of the asterisks, leaving one asterisk at address no. 1, as shown in FIG. 21. The key signature with seven flats has now been assigned to MIDI channel 1.

In order to assign the key signature with six flats to MIDI channel 2, we press the pedal and simultaneously press the channel 2 selecting digital (D3). The display responds as in FIG. 22. Then the whole process for channel 1 is repeated for channel 2, leaving an asterisk in the second position as shown in FIG. 23. And so on for the other fourteen MIDI channels.

The complete look-up table has now been stored in a buffer memory of the message processor. For permanent storage, use the two pushbuttons 14, 15 to get the MAPS main menu and the SAVE sub menu. To save this table as MAP No. 1, press the first of voice control pushbuttons 21 on the keyboard, and any key selection digital. Display 22 now says "DONE!".

To ready the apparatus for key signature actuation, depress the foot pedal and simultaneously press main pushbutton 14 and then sub pushbutton 15 to get the RUN/MIXER mode. Then to load MAP No. 1, press the first one of pushbuttons 21 on the keyboard. The sixteen columns of pitch numbers in the look-up table of FIG. 10 are identified as sixteen different states of the number changer. To select a particular column of pitch numbers, identified as a particular state of the number changer, we must select a particular MIDI channel. Thus to select a particular key signature for actuation, depress the foot pedal and simultaneously press the appropriate channel selection digital of the musical keyboard, as indicated in FIG. 12. To select the key of C, for example, the front digital having the C4 digital code must be pressed. Or to select a key signature having four sharps, the fourth key selection digital to the right of this digital is pressed. Display 22 will indicate which MIDI channel has been selected, and therefore which key signature is being actuated. For example, in FIG. 24 the "S" (for SOLO) indicates that the single key signature with two sharps has been selected. After selection of a key signature of written music the musician plays the notes in the body of the written music, unmodified by its key signature.

OTHER EMBODIMENTS

In a second embodiment of the invention, instead of storing the pitch numbers they are calculated while the music is being played, using basic data such as the number of tones in the diatonic scale. While playing the music, the pitch number is derived from the digital number by dividing the digital number by 7 to obtain an integral quotient Q and a remainder R. For the key of C the standard pitch number P is then obtained from the digital number D by the relation $P=D-Q+5$. Finally the key signature correction is determined by a comparison illustrated in FIG. 25. Referring to FIG. 25, if a key signature containing S sharps has been selected, the correction K is $+1$ when the remainder R is less than S. The correction is zero when the remainder R is equal to or greater than S. For example, for a digital number of 66 the quotient Q is 9 and the remainder R is three. So the standard pitch number for the key of C is $P=66-9+5=62$. Then for a key signature with five sharps the key signature correction K is $+1$ and the corrected pitch number is $P+K=62+1=63$.

An easier way of computing the pitch numbers is to compute a quantity Q as the integral quotient obtained by dividing the quantity $D-V+N$ by seven, where V is a musical key parameter ranging from $-7$ to $+7$, and N is a constant integer. Positive values of V are equal to S, the number of sharps in a key signature; negative values of V are equal to $-F$, where F is the number of flats in a key signature. The pitch numbers P for all musical keys are then obtained by the relationship $P=D-Q+U+M$, where U is a uniform pitch changing parameter and M is a constant integer which is equal to 5 for the digital identifying numbers shown in FIG. 7. If these values of Q or $5-Q$ are stored for all digitals and for all values of V, then it is not necessary to make other corrections for the different key signatures. The values of U and N are normally equal to zero. Indeed this particular set of digital identifying numbers was chosen so as to make N equal to zero.

By storing the pitch numbers for fifteen different values of the musical key parameter V and for a range of values of the uniform pitch changing parameter U, a musician can both actuate a selected key signature and select the overall pitch of his musical output. For example, instead of storing only the pitch numbers shown in FIG. 10, which correspond to the standard value zero for the pitch changing parameter U, the pitch numbers can be stored for values of U equal to $-5$, $-3$, $-1$, $+1$, $+3$, $+5$, in exactly the same way as in the preferred embodiment, but using six different members of the pushbutton array 21 shown in FIG. 12. Then to accommodate a particular singer or group of singers the overall pitch of the output music can be selected by simply pressing an appropriate one of the pushbuttons 21 shown in FIG. 12.

Changes in the uniform pitch changing parameter U never affect the interdigital musical intervals. On the other hand, changes in the musical key selection parameter V within the range zero to +6 always affect the interdigital musical intervals. By combining a uniform pitch changer with a key signature actuator in this way in the same apparatus we avoid any extra sound delay during performance that could be caused by a separate uniform pitch changer.

Since my keyboard shown in FIG. 7 has two redundant digitals per octave span, which can play any pitches (even non-sounding pitches), there are very many ways to construct a useful key signature actuator. In the key of C the z digital can most naturally play either the E tone or the F tone; the x digital can most naturally play either the B tone or the C tone. The combinations of these choices result in the four modes of operation listed in FIG. 26.

Referring to FIG. 26, the first column gives a mode number. The second column lists the four combinations of tone redundancies in the key of C. The third column gives the musical intervals of the musical scale played by the back digitals, and the fourth column gives its starting note in the key of C. In the first three modes the back digitals play the diatonic scale at different overall pitches. The first mode is that of the first three embodiments of the invention, in which the back digitals play a diatonic scale half an octave higher (or lower) than the diatonic scale played by the front digitals, and starting half an octave span to the right (or left) on the keyboard.

In the second mode each redundant back digital sounds the same tone as the front digital to its immediate left. The diatonic scale played by the back digitals is a semitone lower than the diatonic scale played by the front digitals, and it starts one digital to the left on the keyboard.

In the third mode each redundant back digital sounds the same tone as the front digital to its immediate right. The diatonic scale played by the back digitals is a semitone above that played by the front digitals, and it starts one digital to the right on the keyboard.

Key signature corrections for modes 2 and 3 are listed in FIGS. 27 and 28 respectively. In each of these modes the keyboard fingering of a musical composition will be the same for all musical keys. In each of these modes, when a front digital is playing a key signature sharped note the natural note is played as a flat by the back digital on its immediate left. And when a front digital is playing a key signature flatted note the natural note is played as a sharp by the back digital on its immediate right.

Mode 2 can be stored in the equipment of FIG. 12 in exactly the same way as mode 1 of the preferred embodiment, except that at the end one presses pushbutton 2 of array 21, instead of the first pushbutton. If, when playing a musical composition with the key signature actuator in the preferred mode of operation, some back digitals are difficult to finger, then mode 1 may be temporarily replaced by mode 2, simply by pressing the second pushbutton of array 21. This other mode of operation may ease the fingering of those particular back digitals. The other four pushbuttons of array 21 can be used to store pitch numbers for modes 1 and 2 with values of the uniform pitch change parameter U equal to −4 and +4. Selection of these values of U could make the music easier to sing and/or make it sound better.

Instead of receiving and transmitting binary coded numbers serially through a cable containing a single pair of twisted wires, the musical scale changing and key signature actuating apparatus could receive and/or transmit binary coded numbers serially through a fiber optic cable, or through the air by modulation of an optical or radio signal. In all of these embodiments of the invention the binary coded digital identifying numbers would still be received serially on a first pair of electrical conductors and answering binary coded pitch numbers would still be transmitted serially on a second pair of electrical conductors.

The number changer can be packaged with a MIDI merger box, with multiple MIDI inputs and a single MIDI output. Or it can have a single MIDI input and multiple MIDI outputs like a MIDI thru box, as indicated in FIG. 7. And it can have both multiple MIDI inputs and multiple MIDI outputs. These combinations tend to eliminate MIDI receivers and the sound delay times they introduce into musical performance.

Many keyboards have a MIDI transmitter sending keyboard digital messages out and a MIDI receiver for receiving messages from a second keyboard, for generating sound on an internal sound generator contained within the first keyboard enclosure. For such a keyboard the musical scale selector and key signature actuator can receive digital identifying numbers transmitted from the keyboard on a first cable, actuate a key signature, and send answering pitch numbers on a second cable back to the same keyboard, to sound on its own internal sound generator.

The redundant back digitals are not necessarily provided with pitch numbers. However each keyboard digital must have a digital identifying number. If these digital identifying numbers are all used as addresses in a stored look-up table of pitch numbers, then each digital identifying number will naturally be answered by a pitch number. In some cases the answering pitch number may intentionally be a number that will not generate sound in the sound module.

The musical scale changing and key signature actuating features of the apparatus can be extended to selectively induce all the front digitals of the keyboard to sound the hexachord scale which has intertone musical intervals of 2-2-1-2-2-3 semitones. As a basis for music notation the hexachord scale allows a much more intimate relationship between the sounds of music and their representation on paper, and the hexachord scale adapts to a more satisfactory system of (hexachord) key signatures.

A look-up table to actuate the twelve hexachord key signatures described in my U.S. Pat. No. 3,986,422 can be constructed as described herein for the diatonic scale, the pitch numbers for different key signatures being stored and retrieved by using the footswitch 11 shown in FIG. 12 and different keyboard digitals to select different MIDI channels. The complete look-up table can then be permanently stored and temporarily retrieved in the same way as described for the diatonic look-up table, except that a different pushbutton can be pressed in the array 21, shown in FIG. 12.

The look-up tables of pitch numbers can be modified for use with musical keyboards having seven front digitals but only five back digitals per octave span, so as to select musical scales and actuate key signatures by substitutions such as those described in my U.S. Pat. No. 4,048,893. The apparatus can be used to select musical scales and actuate key signatures on musical instruments having only a single row of digitals, such as some MIDI equipped wind instruments. The apparatus can even be used to actuate key signatures on MIDI equipped instruments such as guitars having only strings and frets to identify the different notes of written music.

I claim:

1. An improved musical scale selector for a musical instrument having a group of eight digitals, each of the digitals having associated with it an identifying digital number, when each of the digitals is pressed its associated digital number being transmitted in binary code serially, the improvement comprising:

a first pair of electrical conductors, receiving means for receiving eight digital numbers in binary code serially on the first pair of electrical conductors, a second pair of electrical conductors, transmitting means for transmitting fifteen pitch numbers in binary code on the second pair of electrical conductors, the fifteen pitch numbers constituting a succession of integers having an increase of one between consecutive members of the succession, a number changer connected electrically to the receiving means and the transmitting means, the number changer having a plurality of states in each of which eight of the pitch numbers are associated with the eight digital numbers, one pitch number to each digital number, the eight pitch numbers constituting a series of integers having a sequence of positive differences between consecutive members of the series, the plurality of states including a first state wherein the sequence of differences is 2-2-2-2-2-2-2, the plurality of states including a second state wherein the sequence of differences is 2-2-1-2-2-2-1, means for selecting from the plurality of states of the number changer a single state.

2. The musical scale selector of claim 1 in which the number changer further has a state wherein the sequence of differences is 2-1-2-2-1-2-2.

3. The musical scale selector of claim 2 in which the number changer further has a state wherein the sequence of differences is 1-2-2-2-1-2-2.

4. The musical scale selector of claim 1 in which the number changer further has a state wherein the sequence of differences is 1-2-2-1-2-2-2.

5. The musical scale selector of claim 4 in which the number changer further has a state wherein the sequence of differences is 2-1-2-2-2-1-2.

6. An improved key signature actuator for a musical instrument having a group of eight digitals, each of the eight digitals having associated with it an identifying digital number, when each of the digitals is pressed, its associated digital number being transmitted in binary code serially, the improvement comprising:

a first pair of electrical conductors, receiving means for receiving eight digital numbers in binary code serially on the first pair of electrical conductors, a second pair of electrical conductors, transmitting means for transmitting fifteen pitch numbers in binary code on the second pair of electrical conductors, the fifteen pitch numbers constituting a succession of integers having an increase of one between consecutive members of the succession, a number changer connected electrically to the receiving means and the transmitting means, the number changer having a plurality of states in each of which eight of the pitch numbers are associated with the eight digital numbers, one pitch number to each digital number, the eight pitch numbers constituting a series of integers having a sequence of positive differences between consecutive members of the series, the plurality of states including a first state wherein the sequence of differences is 2-2-1-2-2-2-1, the plurality of states including a second state wherein the sequence of differences is 2-1-2-2-1-2-2, means for selecting from the plurality of states of the number changer a single state.

7. The key signature actuator of claim 6 in which the number changer further has a state wherein the sequence of differences is 1-2-2-2-1-2-2.

8. The key signature actuator of claim 7 in which the number changer further has a state wherein the sequence the differences is 1-2-2-1-2-2-2.

9. The key signature actuator of claims 8 in which the number changer further has a state wherein the sequence of differences is 2-1-2-2-2-1-2.

10. An improved key signature actuator for a musical instrument having means for transmitting note numbers to identify notes of written music, each of the identifying note numbers being transmitted in binary code serially, the improvement comprising:

a first pair of electrical conductors, receiving means for receiving eight note numbers in binary code serially on the first pair of electrical conductors, a second pair of electrical conductors, transmitting means for transmitting fifteen pitch numbers in binary code on the second pair of electrical conductors, the fifteen pitch numbers constituting a succession of integers having an increase of one between consecutive members of the succession, a number changer connected electrically to the receiving means and the transmitting means, the number changer having a plurality of states in each of which eight of the pitch numbers are associated with the eight note numbers, one pitch number to each note number, the eight pitch numbers constituting a series of integers having a sequence of positive differences between consecutive members of the series, the plurality of states including a first state wherein the sequence of differences 2-2-1-2-2-2-1, the plurality of states including a second state wherein the sequence of differences 2-1-2-2-1-2-2, means for selecting from the plurality of states of the number changer a single state.

11. The key signature actuator of claim 10 in which the number changer further has a state wherein the sequence of differences is 1-2-2-2-1-2-2.

12. The key signature actuator of claim 11 in which the number changer further has a state wherein the sequence of differences is 1-2-2-1-2-2-2.

13. The key signature actuator of claims 12 in which the number changer further has a state wherein the sequence of differences is 2-1-2-2-2-1-2.

14. An improved key signature actuator for a musical keyboard having fourteen digitals positioned in a single sequence running from left to right, the fourteen digitals including twelve standard digitals and two extra digitals, each of the fourteen digitals having associated with it an identifying digital number, when each of the digitals is pressed its digital number being transmitted in binary code serially, the improvement comprising:

a first pair of electrical conductors, receiving means for receiving twelve standard digital numbers and two extra digital numbers in binary code serially on the first pair of electrical conductors, a second pair of electrical conductors, transmitting means for transmitting twelve pitch numbers in binary code serially on the second pair of electrical conductors, a number changer connected electrically to the receiving means and the transmitting means, the number changer having a plurality of states in each of which the twelve pitch numbers are associated with the twelve standard digital numbers, one pitch number to each standard digital number, the plurality of states of the number changer including a standard state and at least two key signature states, each of the twelve pitch numbers having a standard value which it assumes in the standard state, each of the key signature states being designated by a number S where S assumes at least two values selected from the group consisting of the numbers 2,3,4,5, each of at least 12-2S of the pitch numbers being exactly equal to its standard value, each of at least 2S-2 of the pitch numbers exceeding its standard value by exactly one, means for selecting from the plurality of states of the number changer a single state.

15. An improved key signature actuator for a musical keyboard having fourteen digitals positioned in a single sequence running from left to right, the fourteen digitals including twelve standard digitals and two extra digitals, each of the fourteen digitals having associated with it an identifying digital number, when each of the digitals is pressed its digital number being transmitted in binary code serially, the improvement comprising:

a first pair of electrical conductors, receiving means for receiving twelve standard digital numbers and two extra digital numbers in binary code serially on the first pair of electrical conductors, a second pair of electrical conductors, transmitting means for transmitting twelve pitch numbers in binary code serially on the second pair of electrical conductors, a number changer connected electrically to the receiving means and the transmitting means, the number changer having a plurality of states in each of which the twelve pitch numbers are associated with the twelve standard digital numbers, one pitch number to each standard digital number, the plurality of states of the number changer including a standard state and at least two key signature states, each of the twelve pitch numbers having a standard value which it assumes in the standard state, each of the key signature states being designated by a number F where F assumes at least two values selected from the group consisting of the numbers 2,3,4,5, each of at least 12-2F of the pitch numbers being exactly equal to its standard value, each of at least 2F-2 of the pitch numbers being less than its standard value by exactly one, means for selecting from the plurality of states of the number changer a single state.

* * * * *